United States Patent [19]

Takai et al.

[11] Patent Number: 5,041,878

[45] Date of Patent: Aug. 20, 1991

[54] METHOD FOR FORMING AND TRANSFERRING COLOR IMAGES

[75] Inventors: Yasuhiro Takai, Sakurai; Taisuke Kamimura, Nara; Yoichi Shimazawa, Nara; Etsuzi Nukushina, Nara, all of Japan

[73] Assignee: Sharp Kabushiki Kaisha, Osaka, Japan

[21] Appl. No.: 456,864

[22] Filed: Dec. 27, 1989

[30] Foreign Application Priority Data

Jan. 9, 1989 [JP] Japan ..... 1-2601

[51] Int. Cl.[5] ..... G03G 15/14; G03G 15/01

[52] U.S. Cl. ..... 355/273; 355/272; 355/326

[58] Field of Search ..... 355/271, 272, 273, 274, 355/281, 327, 326, 311; 430/126

[56] References Cited

U.S. PATENT DOCUMENTS

| | | | |
|---|---|---|---|
| 4,431,301 | 2/1984 | Hashimoto et al. | 355/274 |
| 4,468,113 | 8/1984 | Motohashi et al. | 355/271 X |
| 4,733,269 | 3/1988 | Kasahara et al. | 355/271 X |
| 4,862,214 | 8/1989 | Kasahara et al. | 355/277 |
| 4,872,037 | 10/1989 | Kasahara et al. | 355/271 |
| 4,931,839 | 6/1990 | Tompkins et al. | 355/271 X |
| 4,933,727 | 6/1990 | Mizuma et al. | 355/272 X |

FOREIGN PATENT DOCUMENTS

| | | |
|---|---|---|
| 0124361 | 8/1982 | Japan . |
| 0059368 | 3/1986 | Japan . |
| 0254172 | 11/1987 | Japan . |
| 0264768 | 11/1987 | Japan . |
| 0298265 | 12/1988 | Japan . |

*Primary Examiner*—A. T. Grimley
*Assistant Examiner*—Nestor R. Ramirez

[57] ABSTRACT

In a transfer method of a colored image, the process speed is initially properly set in accordance with the size of a copy paper sheet to be used. The transfer voltage is then changed in accordance with the process speed. After these processes, a colored toner image formed on a photoconductor is first transferred onto an intermediate transfer medium and then further transferred onto the copy paper sheet.

21 Claims, 3 Drawing Sheets

METHOD FOR FORMING AND TRANSFERRING COLOR IMAGES

BACKGROUND OF THE INVENTION

1. Field of the Invention

The present invention relates to a transfer method of a colored image in a full-color copying apparatus or the like employing therein an intermediate transfer medium.

2. Description of the Prior Art

Conventionally, in a full-color copying apparatus employing an intermediate transfer medium such as an intermediate transfer belt, toner images in three primary colors (yellow, magenta and cyan) are initially independently formed on a photoconductor belt. The toner images are overlapped one upon another on the intermediate transfer belt, and a resultant toner image is transferred onto a copy paper sheet.

In the conventional full-color copying apparatus, the voltage applied to a transfer roller is kept constant. Accordingly, in view of the transfer efficiency for example, it is necessary to make the size of the intermediate transfer belt longer than the maximum size of copy paper sheets usable in the apparatus. It is also necessary to make the distance between the transfer roller and a fixing device longer than the maximum size of the copy paper sheets. In other words, the size of the apparatus is restricted by the maximum size of the copy paper sheets. This is disadvantageous because it is difficult to form the apparatus to a compact size.

SUMMARY OF THE INVENTION

Accordingly, the present invention has been developed with a view to substantially eliminating the above described disadvantage, and has for its essential object to provide an improved transfer method of a colored image, which aids in a miniaturization of a full-color copying apparatus.

Another important object of the present invention is to provide a transfer method of the above described type which can reproduce the colored image in high quality.

In accomplishing these and other objects, the transfer method according to the present invention includes the steps of changing the process speed in accordance with the size of a copy paper sheet to be used the transfer voltage is also changed in accordance with the process speed, in the method at least one colored toner image formed on a photoconductor is first transferred onto an intermediate transfer medium, and further transferring the colored toner image from the intermediate transfer medium onto the copy paper sheet.

In this method, when the paper size is small, the process speed is made fast, for example 184 mm/sec, whereas the paper size is large, the process speed is made slow, for example 115 mm/sec. Furthermore, when the process speed is fast, a high voltage of 1.5–2.0 KV is applied to a transfer roller whereas the process speed is slow, a low voltage of 1.1–1.5 KV is applied to the transfer roller.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
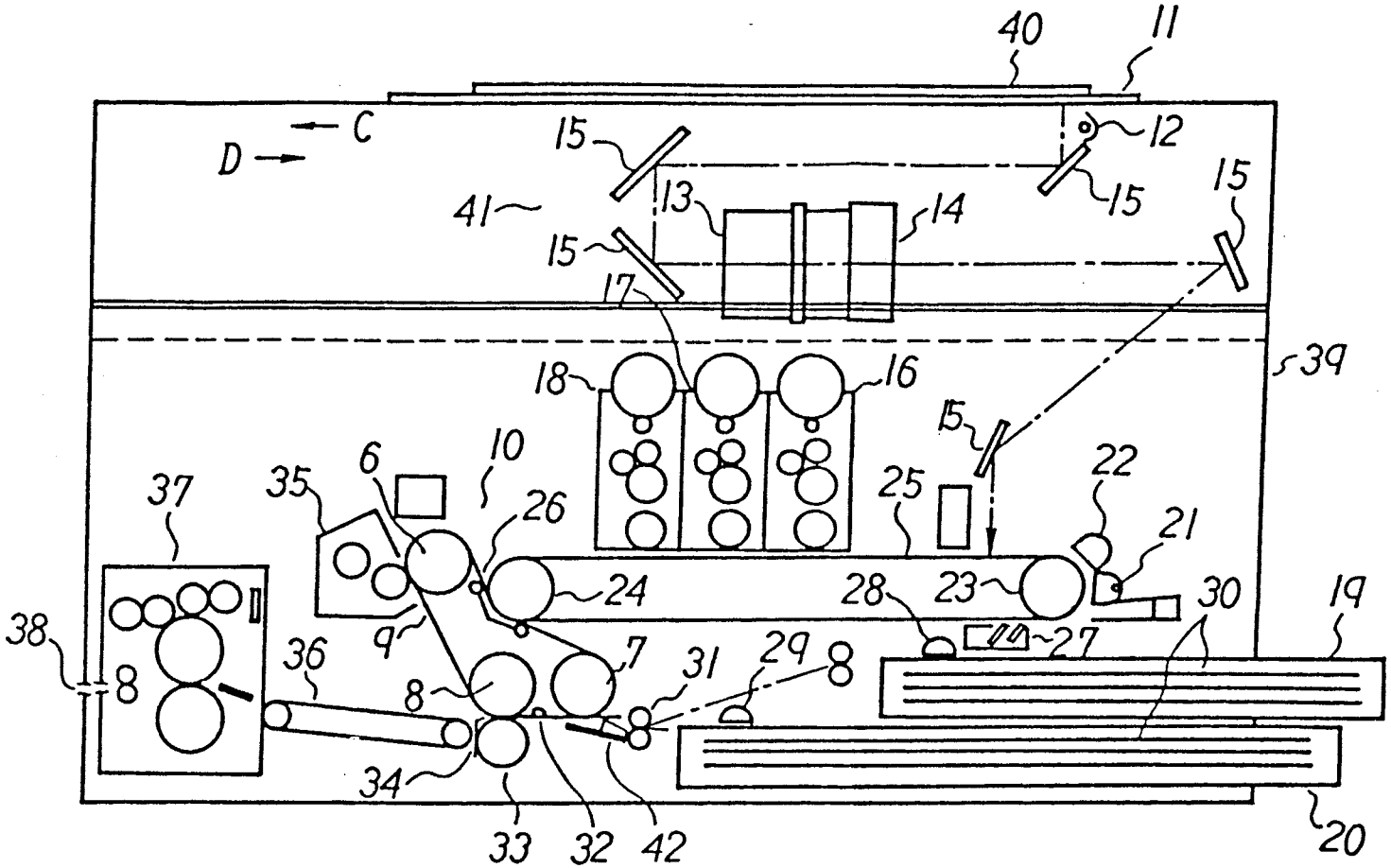
FIG. 1 is a schematic elevational view of a copying apparatus employing therein a transfer method according to the present invention.

Referring now to the drawings, there is shown in FIG. 1, a full-color copying apparatus employing therein a transfer method of a colored image according to the present invention.

As shown in FIG. 1, a document platform 11, on which an original document 40 to be copied is placed, is disposed on the upper surface of an apparatus housing 39. Below the document platform 11 there is an optical system 41 for forming an electrostatic latent image on a photoconductor belt 25 by scanning the document 40 placed on the document platform 11. The optical system 41 includes a copy lamp 12, a lens 13, a plurality of mirrors 15 and a filter assembly 14 comprised of blue, red and green filters.

The photoconductor belt 25 of organic material (organic photoconductor) is disposed below the optical system 41 and passed around a drive roller 24 and a driven roller 23, both of which are in parallel to each other and spaced at a predetermined interval. Around the photoconductor belt 25 are disposed a charger 22, three developing devices 16, 17 and 18, a cleaner 27 and an eraser lamp 21, all of which confront the photoconductor belt 25. The developing devices 16, 17 and 18 accommodate respective developers in yellow, magenta and cyan.

An intermediate transfer device 10 is disposed in the vicinity of the drive roller 24 and comprises a drive roller 6, a driven roller 7, a back-up roller 8, an intermediate transfer belt 9 passed around the rollers 6–8, an electrode roller 32, a transfer roller 33, a separation plate 34, a cleaner 35 and a transfer mechanism 26 including an intermediate transfer charger.

Figure 3:
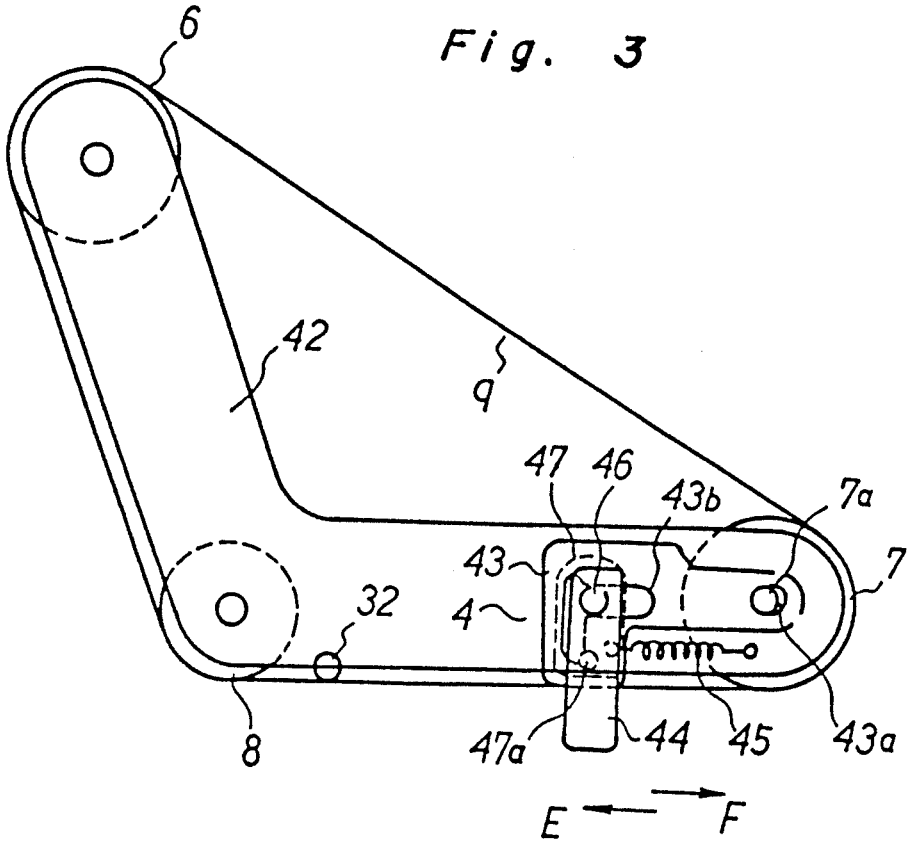
FIG. 3 is an elevational view of a mechanism for applying tension to the intermediate transfer belt.

The rollers 6, 7 and 8 are disposed in parallel to the drive roller 24 and spaced from each other substantially in a triangular form. Opposite ends of the rollers 6, 7 and 8 are rotatably supported by a pair of support plates 49, as shown in FIG. 3.

Each support plate 49 is provided with a tension mechanism 4, which applies appropriate tension to the intermediate transfer belt 9 by moving the roller 7 in the direction shown by an arrow E or F. The tension mechanism 4 is provided with a plate 43 movable in the directions of the arrows E and F, a cam 47 for moving the plate 43, a lever 44 for operating the cam 47, a rod 46 for connecting the lever 44 with the cam 47, and a spring 45 for biasing the plate 43 in the direction of the arrow F. The plate 43 has one end portion in which an elongated opening **43*a* is formed and the other end portion in which a substantially L-shaped opening 43*b* is formed. The rod 46 and a pin 47*a* rigidly secured to the cam 47 extend through the L-shaped opening 43*b* whereas a roller shaft 7*a* of the roller 7 is loosely inserted in the elongated opening 43*a*. The operation of the lever 44** causes the cam 47 to swivel, resulting in the movement of the pin 47*a*. Accordingly, the plate 43 is moved in the direction of the arrow F by the biasing force of the spring 45 and the roller 7 is moved in the same direction.

The intermediate transfer belt 9 can rotate in both directions and a portion thereof between the rollers 6 and 7 is in pressure contact with the photoconductor belt 25 located on the periphery of the drive roller 24.

The drive roller 6 is of conductive rubber and has a diameter of, for example, approximately 50 mm. The driven roller 7 is of aluminum and has a diameter of, for example, approximately 42 mm. The back-up roller 8 is of insulating rubber and has a diameter of, for example, approximately 25 mm. The insulating rubber includes silicone rubber or the like having a resistivity of, for example, approximately $10^{12}$–$10^{14}\Omega\cdot$cm.

Figure 2:
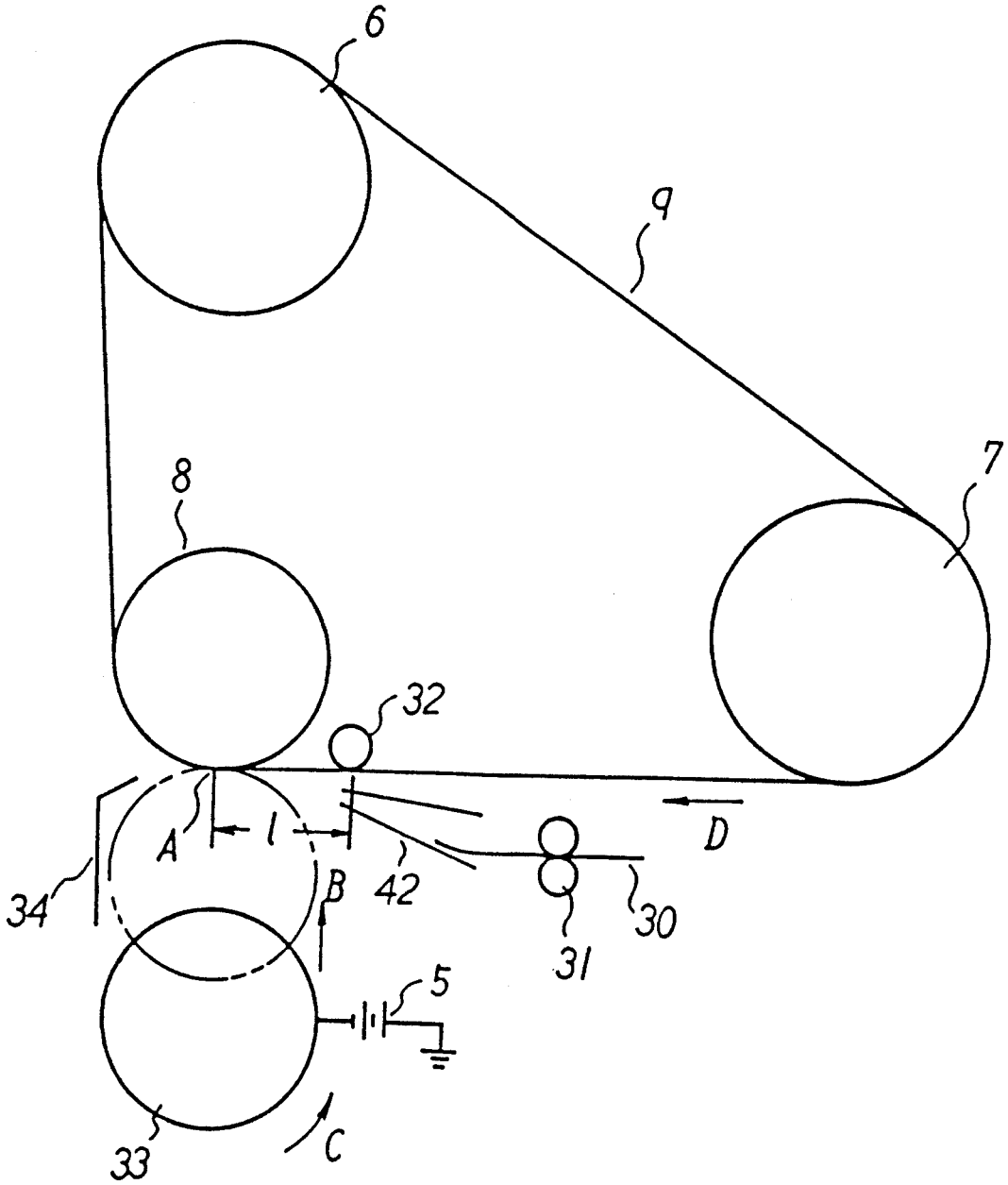
FIG. 2 is a schematic view showing the relationship between an intermediate transfer belt and a transfer roller disposed in the apparatus of FIG. 1.

As shown in FIG. 2, the electrode roller 32 is disposed in the vicinity of the back-up roller 8 and between the driven roller 7 and the back-up roller 8. More specifically, the electrode roller 32 is in contact with the rear surface of the intermediate transfer belt 9 at a location l mm apart from a point A where the back-up roller 8 confront the transfer roller 33, with the intermediate transfer belt 9 and a copy paper sheet 30 being interposed therebetween. The distance l is approximately 10–18 mm. The electrode roller 32 is of, for example, stainless steel and has a diameter of approximately 8 mm. This roller 32 is a driven roller extending throughout the whole width of the intermediate transfer belt 9 and grounded to the earth.

The transfer roller 33 can move in the direction of an arrow B or in the direction opposite thereto and rotate in the direction of an arrow C. The transfer roller 33 can be brought into pressure contact with the intermediate transfer belt 9 by moving the transfer roller 33 in the direction of the arrow B. A transfer voltage supplied from a power source 5 is applied to the transfer roller 33.

A pair of timing rollers 31 and a paper guide 42 are disposed outside of the intermediate transfer belt 9 in the vicinity of the electrode roller 32. The timing rollers 31 feed each copy paper sheet 30 to a space between the intermediate transfer belt 9 and the transfer roller 33 through the paper guide 42.

Two paper cassettes 19 and 20 are detachably mounted in the apparatus housing 39 on the right side as viewed in FIG. 1. These paper cassettes 19 and 20 are disposed one above the other and can accommodate a number of copy paper sheets 30. Above the paper cassettes 19 and 20 are disposed respective paper feed rollers 28 and 29, which feed the copy paper sheets 30 accommodated in the paper cassettes 19 and 20 to the paired timing rollers 31.

The copy paper sheets 30 discharged from the intermediate transfer device 10 are fed to a fixing device 37 by a transport belt 36 and finally to a discharge portion 38. The transport belt 36, fixing device 37 and discharge portion 38 are disposed on the left side of the intermediate transfer device 10 as viewed in FIG. 1.

Figure 4:
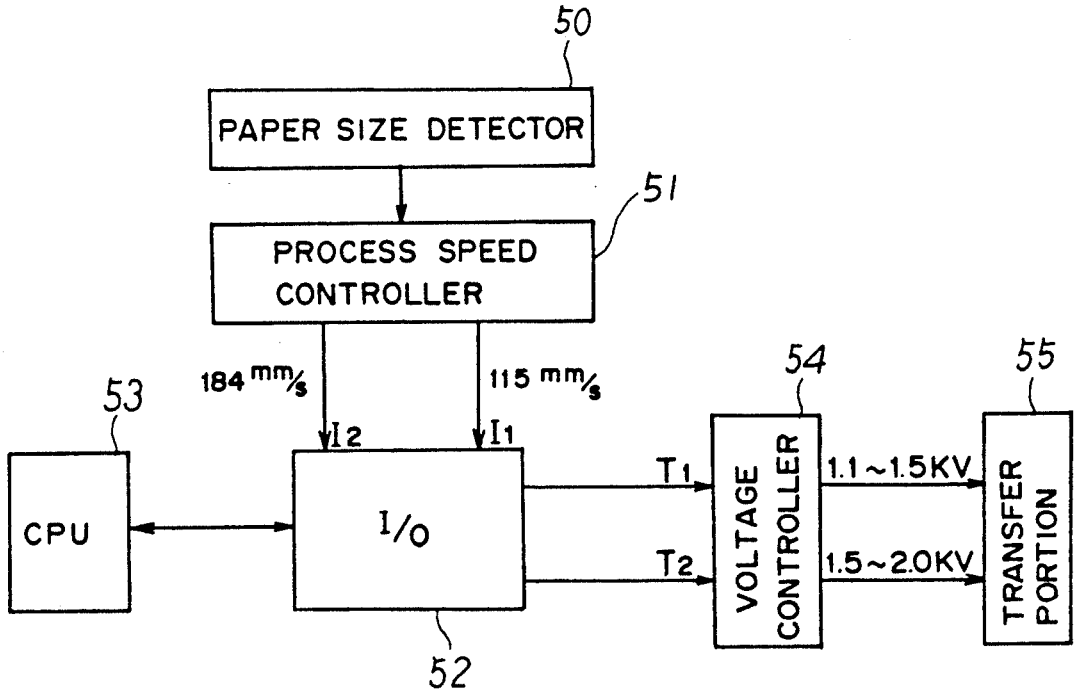
FIG. 4 is a circuit diagram for controlling the voltage applied to the transfer roller.

FIG. 4 depicts a circuit diagram for controlling the voltage applied to the transfer roller 33.

In FIG. 4, a paper size detector 50 detects the size of copy paper sheets and outputs a discrimination signal to a process speed controller 51. The discrimination signal indicates either the maximum size or the minimum size of the copy paper sheets, for example B4 or B5, by making use of a key operation signal sent from a paper size selector key. The process speed controller 51 controls the process speed according to the signal outputted from the paper size detector 50. When the process speed controller 51 receives a signal indicative of the maximum size, it makes the process speed slow, for example 115 mm/sec, and outputs a speed discrimination signal I1 to a CPU 53 through an I/O port 52. In contrast, when the process speed controller 51 receives a signal indicative of the minimum size, it makes the process speed fast, for example 184 mm/sec, and outputs a speed discrimination signal I2 to the CPU 53 through the I/O port 52.

The CPU 53 outputs either a signal T1 or a signal T2 to a voltage controller 54 according to the speed discrimination signal I1 or I2 from the process speed controller 51. More specifically, the CPU 53 outputs the signal T1 when the process speed is slow whereas the CPU 53 outputs the signal T2 when the process speed is fast. When the voltage controller 54 receives the signal T1, a low voltage of 1.1–1.5 KV is applied to the transfer roller 33 provided in a transfer portion 55. In contrast, when the voltage controller 54 receives the signal T2, a high voltage of 1.5–2.0 KV is applied to the transfer roller 33.

Copy paper sheets of any other size are also usable in the apparatus of FIG. 1. In the case of copy paper sheets of A4-size, the process speed is set to a speed between 115 mm/sec appropriate to B4-size and 184 mm/sec appropriate to B5-size. For example, the process speed is set to approximately 150 mm/sec. In this case, the transfer voltage is determined according to the process speed. It is noted that copy paper sheets of A4-size may be controlled in the same way as those of B5-size.

The copying apparatus of FIG. 1 operates as follows.

In copying operation, the optical system 41 including the copy lamp 12, mirrors 15 and the like initially moves back and forth in the direction of arrows G and H below the document platform 11 so that an original document 40 placed on the document platform 11 may be scanned. Light emitted from the copy lamp 12 is applied to and reflected by the document 40. The reflected light reaches the surface of the photoconductor belt 25 via the mirrors 15, lens 13 and filter assembly 14, as shown by a single dotted chain line in FIG. 1, so that an electrostatic latent image may be formed on the photoconductor belt 25. In the case of full-color copying, the document 40 is scanned three times. In this case, the filter assembly 14 inserts each of three color-filters in a light path at the time of each scanning, thereby successively forming three electrostatic latent images on the photoconductor belt 25.

These electrostatic latent images are in turn developed by the developers in yellow, magenta and cyan accommodated in the developing devices 16–18. Toner images obtained in this way are transferred onto the intermediate transfer belt 9 from the surface of the photoconductor belt 25 by the transfer mechanism 26 and overlapped one upon another. Thus, a resultant colored toner image is formed on the intermediate transfer belt 9.

On the other hand, copy paper sheets 30 accommodated in the paper cassette 19 or 20 are fed sheet by sheet to the timing rollers 31 by the paper feed roller 28 or 29. The timing rollers 31 transport each copy paper sheet 30 to a space between the intermediate transfer belt 9 and the transfer roller 33 in synchronization with the intermediate transfer belt 9. After the colored toner image formed on the intermediate transfer belt 9 has been transferred onto the copy paper sheet 30, this sheet 30 is separated from the intermediate transfer belt 9 by the separation plate 34. The copy paper sheet 30 having thereon the colored toner image is introduced by the transport belt 36 to the fixing device 37, in which the copy paper sheet 30 is subjected to heat and pressure for the fixing. Thereafter, the copy paper sheet 30 is discharged outside from the discharge portion 38.

When copy paper sheets of B5-size are selected by a selection key prior to the copying operation, the paper size detector 50 judges the size thereof as the minimum size. The process speed controller 51 receives a signal outputted from the paper size detector 50 and controls the process speed to 184 mm/sec in compliance thereto. When the CPU 53 outputs a control signal T2 to the voltage controller 54 in response to a control signal I2 outputted from the process speed controller 51, the voltage controller 54 controls so that a voltage of 1.5–2.0 KV may be applied to the transfer roller 33 of the transfer portion 55. In this way, when the paper size is minimum, the process speed is made fast and the voltage applied to the transfer roller 33 is made high.

In contrast, when copy paper sheets of B4-size are selected by the selection key, the paper size detector 50 judges the size thereof as the maximum size. The process speed controller 51 receives a signal outputted from the paper size detector 50 and controls the process speed to 115 mm/sec in compliance thereto. When the CPU 53 outputs a control signal T1 to the voltage controller 54 in response to a control signal I1 outputted from the process speed controller 51, the voltage controller 54 controls so that a 15 voltage of 1.1–1.5 KV may be applied to the transfer roller 33. In this way, when the paper size is maximum, the process speed is made slow and the voltage applied to the transfer roller 33 is made low.

Accordingly, even when the size of the intermediate transfer belt is small and the distance between the transfer roller and the fixing device is short, high image quality can be always kept irrespective of the paper size by effectively controlling the process speed and the voltage applied to the transfer roller.

As is clear from the foregoing, the transfer method of a colored image according to the present invention is greatly conducive to a small-sized copying apparatus which can reproduce images in high quality.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A transfer method for colored images comprising the steps of:

(a) changing a process speed in accordance with a size of a copy sheet to be used;

(b) changing a transfer voltage, which is always greater than zero, in accordance with said process speed;

(c) first transferring at least one colored toner image formed on a photoconductor onto an intermediate transfer medium; and (d) secondly transferring the colored toner image from the intermediate transfer medium onto the copy sheet.

2. A transfer method of a colored image comprising the steps of:

(a) changing a process speed in accordance with a size of a copy paper sheet to be used, wherein said process speed ranges between 115 and 184 mm/sec (b) changing a transfer voltage in accordance with said process speed, wherein said transfer voltage ranges between 1.1 and 2.0 KV (c) first transferring at least one colored toner image formed on a photoconductor onto an intermediate transfer medium; and (d) secondly transferring said colored toner image from the intermediate transfer medium onto said copy paper sheet.

3. The method of claim 1 wherein the copy sheet is paper.

4. A transfer method for transferring colored images onto a copy sheet comprising the steps of:

(a) varying a process speed dependant on the size of a copy sheet to be used;

(b) first transferring at lest one colored toner image formed on a photoconductor onto an intermediate transfer medium; and (c) secondly transferring the colored toner image from the intermediate transfer medium onto the copy sheet; and (d) using a varying transfer voltage which is always greater than zero dependent on the process speed in step (c).

5. The method of claim 4 wherein the transfer voltage is varied by increasing its amount when the amount of process speed has been increased.

6. The method of claim 4 wherein the photoconductor in step (b) is a belt.

7. The method of claim 4 wherein the intermediate transfer medium is a belt.

8. The method of claim 4 wherein the transfer voltage is applied to the transfer medium.

9. The method of claim 4 wherein the transfer voltage is applied directly to a transfer roller.

10. The method of claim 9 wherein there is a variable power source operatively connected to the transfer roller.

11. The method of claim 4 further comprising the step of (e) separating the copy sheet from the intermediate transfer medium.

12. The method of claim 11 wherein step (e) is performed by the use of a plate.

13. The method of claim 4 further comprising the step applying a separating plate to the transfer medium and the copy sheet to effectuate separation of the transfer medium from the copy sheet.

14. The method of claim 4 wherein the copy sheet is paper.

15. The method of claim 4 wherein the process speed is about 184 mm/sec.

16. The method of claim 15 wherein the transfer voltage is in the range of about 1.5–2.0 KV.

17. The method of claim 4 wherein the process speed is about 115 mm/sec.

18. The method of claim 17 wherein the transfer voltage is in the range of about 1.1–1.5 KV.

19. The method of claim 4 wherein the size of the copy sheet can vary from small to large and when the copy sheet size is reduced, the process speed is increased and the transfer voltage is increased.

20. The methods of claim 4 wherein the size of the copy sheet can vary from small to large and when the copy sheet size is increased the process speed is reduced and the transfer voltage is reduced.

21. A transfer method for toner images comprising the steps of:

(a) determining a size of a copy sheet to be used;

(b) performing an image formation at a first process speed when a copy sheet of a first size is used and at a second process speed faster than said first process speed when a copy sheet of a second size smaller than said first size is used; and (c) applying a first voltage to a transfer means so that a toner image formed on a recording medium in accordance with said first process speed is transferred onto the copy sheet of said first size and applying a second voltage higher than said first voltage to said transfer means so that a toner image formed on said recording medium in accordance with said second process speed is transferred onto the copy sheet of said second size.

* * * * *